US006701911B2

(12) United States Patent
Giacomin

(10) Patent No.: US 6,701,911 B2
(45) Date of Patent: Mar. 9, 2004

(54) ADJUSTMENT DEVICE, PARTICULARLY FOR ADJUSTING THE LEVELNESS OF A SURFACE OR OF AN ELECTRIC APPLIANCE

(75) Inventor: Lorenzo Giacomin, Conegliano (IT)

(73) Assignee: Techimpex Italiana S.r.l., Susegana (IT)

( * ) Notice: Subject to any disclaimer, the term of this patent is extended or adjusted under 35 U.S.C. 154(b) by 0 days.

(21) Appl. No.: 09/741,352

(22) Filed: Dec. 21, 2000

(65) Prior Publication Data

US 2001/0006065 A1 Jul. 5, 2001

(30) Foreign Application Priority Data

Dec. 29, 1999 (SM) ..... SMA 199900005

(51) Int. Cl.[7] ..... F42C 15/30; A47F 5/12

(52) U.S. Cl. ..... 126/24; 126/349; 114/193; 108/1; 108/6

(58) Field of Search ..... 126/24, 1 R, 349; 114/188, 191, 193; 248/311.2, 188.2; 431/343; 108/6, 1

(56) References Cited

U.S. PATENT DOCUMENTS 206,393 A * 7/1878 Ellinger ..... 105/150
456,357 A * 7/1891 Dee ..... 126/24
1,421,890 A 7/1922 Baker
1,826,578 A * 10/1931 Schmitt ..... 248/188.2
3,712,570 A * 1/1973 Stone et al. ..... 248/133
3,856,248 A * 12/1974 Labelle ..... 248/188.2
3,991,962 A * 11/1976 Kovats ..... 248/188.3
4,445,495 A 5/1984 Frost
4,474,115 A * 10/1984 Carlton ..... 108/7
4,572,944 A * 2/1986 Ballard ..... 219/391
5,074,221 A * 12/1991 Lochridge ..... 108/6
5,398,620 A * 3/1995 Rouch ..... 108/1
6,142,542 A * 11/2000 Sherno ..... 293/132
6,169,720 B1 * 1/2001 Kamemura et al. ..... 369/75.2
6,244,552 B1 * 6/2001 Adams et al. ..... 248/202.1
6,435,174 B1 * 8/2002 Spilde et al. ..... 126/378.1
6,520,473 B2 * 2/2003 Lee ..... 248/352
6,561,183 B1 * 5/2003 Spilde et al. ..... 126/378.1

* cited by examiner

*Primary Examiner*—Henry Bennett
*Assistant Examiner*—Kathryn Odland
(74) *Attorney, Agent, or Firm*—Guido Modiano; Albert Josif; Daniel O'Byrne

(57) ABSTRACT

An adjustment device, particularly for adjusting the levelness of a surface or of an electric appliance, such as for example a set of burners of a cooker for watercraft, comprising two side panels provided with two pivots for pivoting to a fixed support. The pair of pivots is slidingly located in a longitudinal seat and interacts with means for varying the position of the pivots which can be activated by the user.

12 Claims, 6 Drawing Sheets

ADJUSTMENT DEVICE, PARTICULARLY FOR ADJUSTING THE LEVELNESS OF A SURFACE OR OF AN ELECTRIC APPLIANCE

BACKGROUND OF THE INVENTION

The present invention relates to an adjustment device, particularly for adjusting the levelness of a surface or of an electric appliance, such as for example a set of burners of a cooker for watercraft.

Currently, in the nautical sector it is known to provide fittings which use surfaces or electric appliances which must be arranged in a horizontal position in order to be used correctly.

This aspect clashes with the fact that during certain types of sailing, for example during close-hauling, the boat remains more or less constantly tilted to one side at a certain angle.

This is due to the fact that it is not possible to fully compensate for the presence of crosswind, which increases as one sails closer to the wind, i.e., as one sails upwind.

The fact that the vessel has this tilt, which in large vessels such as cruise ships remains constant for long periods, causes the problem that it is not possible to perform all those operations that require the availability of a substantially horizontal surface.

One of these cases occurs, for example, for cooking food on sets of burners of cookers for watercraft, which nowadays has been partly remedied by means of conventional devices for compensating for lateral tilting.

These devices, which also act as limiters and damping elements for the oscillations caused by the rolling of the vessel, substantially consist of a pair of pivots which are rigidly coupled to, and protrude outward from, for example the opposite lateral panels of the cooker unit that supports the set of burners.

The pair of pivots is usually arranged proximate to the upper side of the panels, advantageously proximate to the centerline of the lateral panels of the cooker unit.

The two pivots are accommodated in appropriate seats provided for example on two vertical wings which are rigidly coupled to a support which is fixed to the vessel.

Such pivots, by being able to rotate freely in the respective seats, allow for example the cooker unit to remain vertical, since the rotation of the watercraft does not affect its position because the contacts between the watercraft and the cooker unit are limited only to the pivots.

The main drawback of this device is the fact that the center of gravity of the cooker unit is not fixed in a single position but varies according to the weight and arrangement of the items placed on the surface or on the worktop of the electric appliance.

A frequent drawback occurs, for example, when one rests a pot or heavy container close to the front or rear edge of a set of burners of a cooker unit for nautical use.

Such additional weight, if it is not negligible with respect to the weight of the surface or of an electric appliance and if it lies outside of the axis traced by the line that joins the two pivots, shifts the overall center of gravity and therefore may cause the content of the pot to spill.

A similar problem arises when one has to open the oven door: due to its own weight, the door may cause the rotation of the cooker unit and may cause a small pot placed on the burners to move and fall.

SUMMARY OF THE INVENTION

The aim of the present invention is to solve the above-noted problems, eliminating the drawbacks of the cited prior art, by providing a device which allows to use, in a watercraft, a supporting or cooking surface which can remain level even when the weights arranged on it vary.

Within the scope of this aim, an important object of the present invention is to provide a device in which its levelness can be achieved rapidly and easily by the user as the weights arranged thereon vary.

Another important object is to provide a device which does not require particular tools for its activation.

Another object is to provide a device which is structurally simple and has low manufacturing costs.

This aim and these and other objects which will become better apparent hereinafter are achieved by an adjustment device, particularly for adjusting the levelness of a surface or of an electric appliance having two side panels provided with two pivots for pivoting to a fixed support, characterized in that said pair of pivots is slidingly located in a longitudinal seat and interacts with position-varying means which can be activated by the user.

BRIEF DESCRIPTION OF THE DRAWINGS

Further characteristics and advantages of the invention will become better apparent from the following detailed description of a particular embodiment thereof, illustrated only by way of non-limitative example in the accompanying drawings, wherein.

DESCRIPTION OF THE PREFERRED EMBODIMENTS

Figure 1:
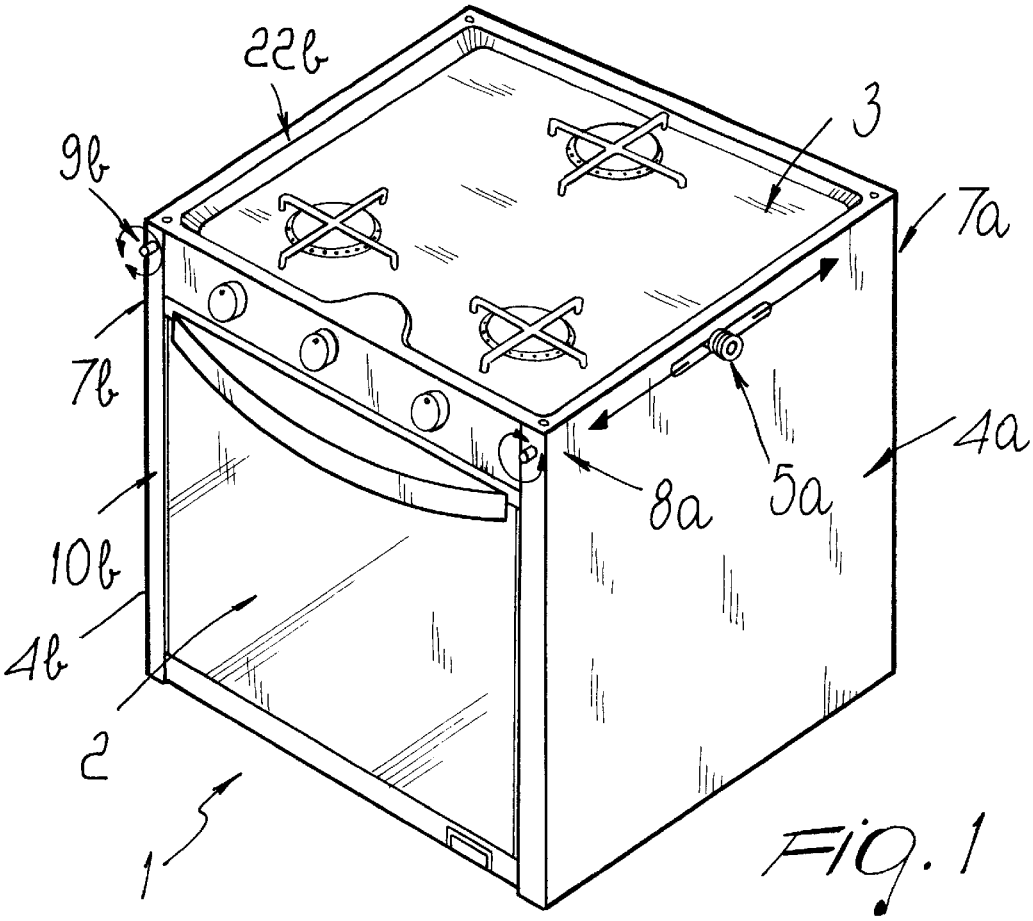
FIG. 1 is a perspective view of the invention used in combination with a cooker unit.
Figure 2:
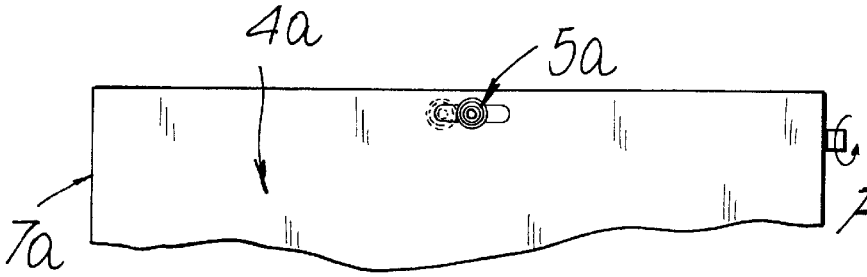
FIGS. 2 and 3 are side views of the invention in a first operating mode and in a second operating mode.
Figure 3:
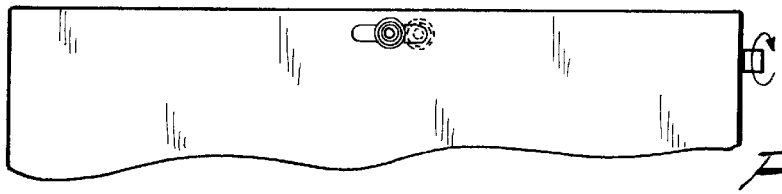
Figure 4:
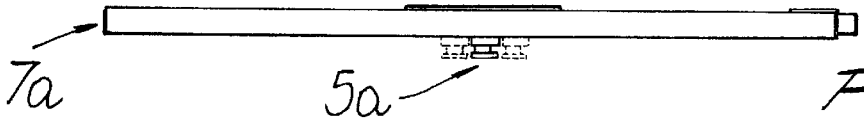
FIG. 4 is a plan view of the invention used in different modes.
Figure 6:
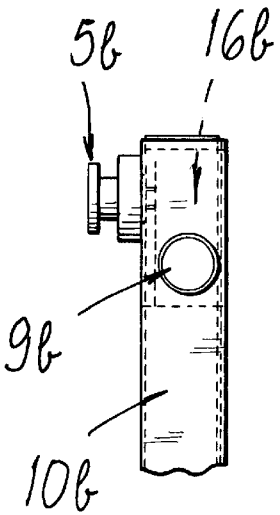
FIGS. 5 and 6 are respectively a side view and a front view of the levelness adjustment device in a first operating mode and in a second operating mode.
Figure 5:
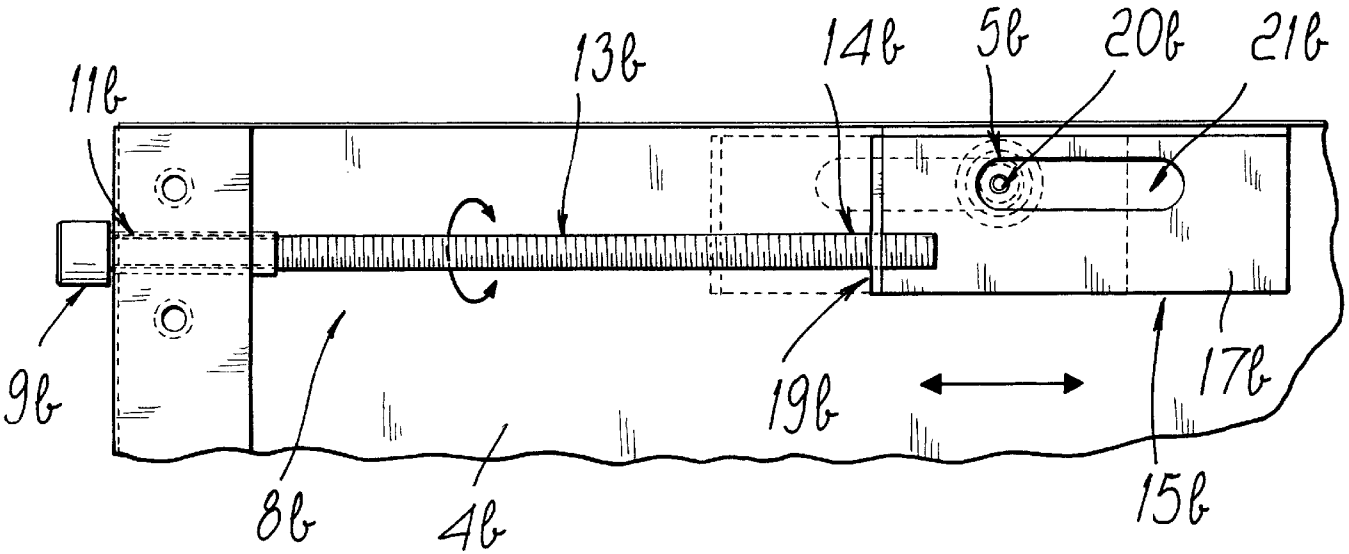
Figure 7:
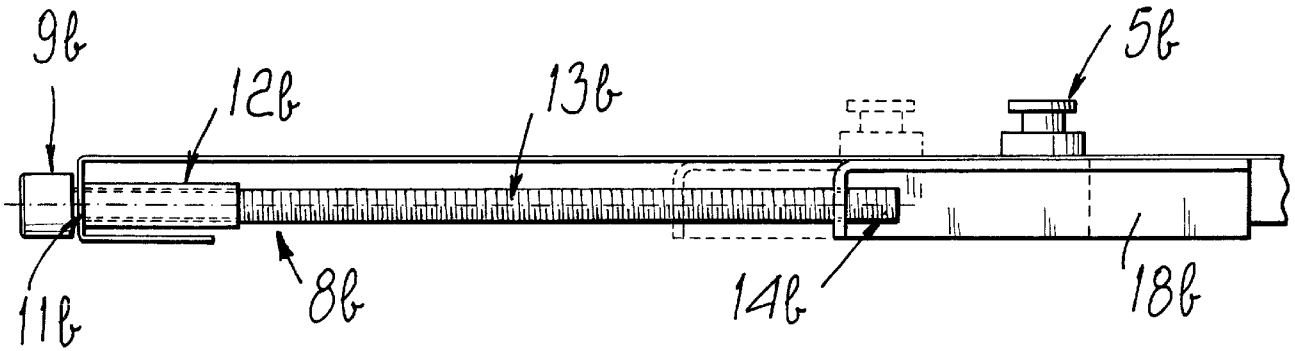
FIG. 7 is a sectional plan view of the levelness adjustment device, in a first operating mode and in a second operating mode.
Figure 8:
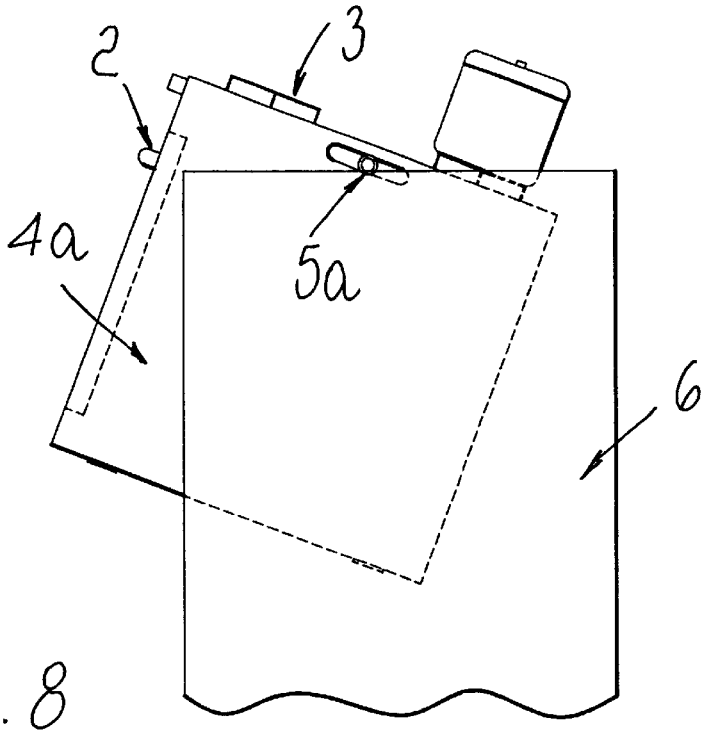
FIGS. 8 and 9 are side views of the invention used in combination with a cooker unit, respectively before and after levelness adjustment required by the placement of a pot.
Figure 9:
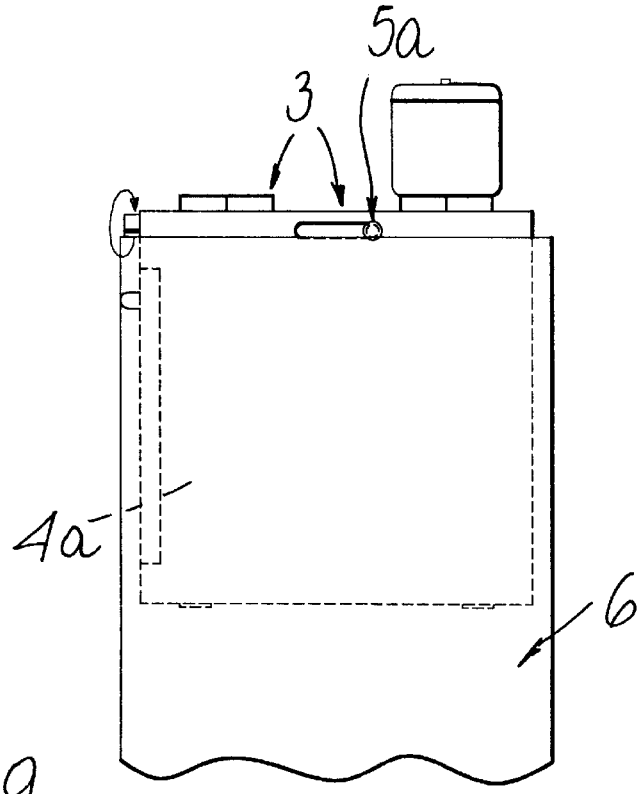
Figure 10:
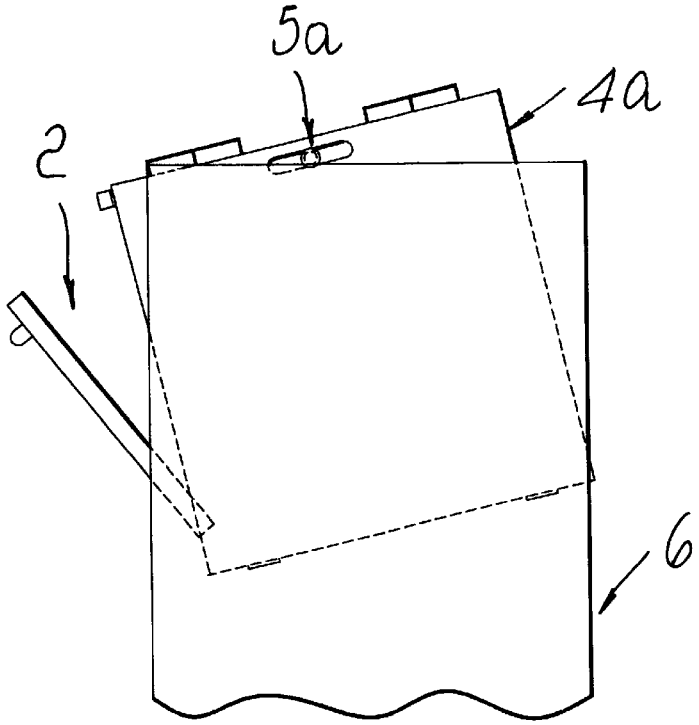
FIGS. 10 and 11 are side views of the invention used in combination with a cooker unit, respectively before and after the levelness adjustment required by the opening of the oven door.
Figure 11:
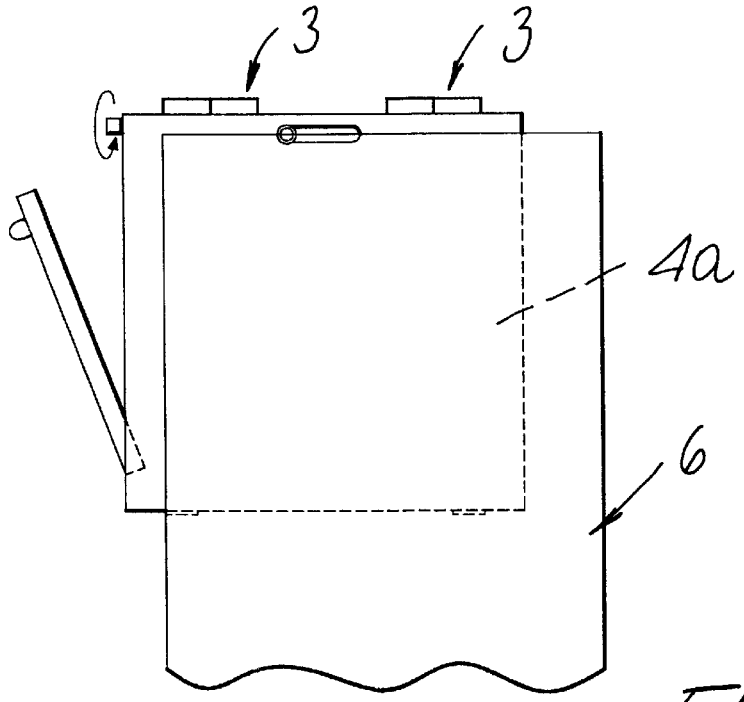

With reference to the figures, the reference numeral 1 designates a cooker unit for watercraft, which is constituted by a cooking oven 2 above which a set of burners designated by the reference numeral 3 is provided.

The cooker unit 1 is provided with two side panels, designated by the reference numerals 4*a* and 4*b,* which have a pair of respective pivots 5*a* and 5*b* for pivoting to a fixed support which is advantageously constituted by two vertical elements which are generally designated by the reference numeral 6.

The cooker unit 1, by being in contact with the watercraft only at pivots 5*a* and 5*b,* is thus rotatably coupled to the fixed vertical elements 6.

Proximate to upper sides 7*a* and 7*b* of the side panels 4*a* and 4*b* there is a levelness adjustment device which is constituted by a pair of mechanisms, designated by the reference numeral 8*a* and 8*b* and each conveniently arranged at the respective upper side 7*a* and 7*b*.

Of mechanisms 8*a* and 8*b,* which are mutually mirror-symmetrical with respect to a vertical plane, only mechanism 8*b* is described hereafter, mechanism 8*a* being exactly the same with the same element.

The mechanism 8*b* is advantageously constituted by appropriate means, for example a knob, designated by the reference numeral 9*b,* which are adapted to vary the position of the pivots and therefore of the cooker unit 1 with respect to the fixed vertical elements 6.

The knob 9*b* protrudes rotatably from the front surface, designated by the reference numeral 10*b,* of the side panel 4*b,* at a first hole 11*b*.

A first end 12*b* of a threaded bar, designated by the reference numeral 13*b,* is rigidly coupled to the knob 9*b* at its axis directed toward the inside of the cooker unit.

The threaded bar 13*b* is conveniently arranged at right angles to said front surface 10*b* and is screwed at a second end 14*b* to a wing of a bracket, designated by the reference numeral 15*b,* which has a box-like shape.

The bracket 15*b,* which is advantageously made of metal, accordingly has a first flat surface 16*b,* a second flat surface 17*b,* and a third flat surface 18*b* which have a rectangular plan shape and are arranged at right angles to each other.

The first surface 16*b,* arranged at right angles to the threaded bar 13*b,* has a second hole 19*b* which is threaded complementarily to the threaded bar for rotary connection to the bar.

The second surface 17*b* is advantageously arranged parallel to the side panel 4*b*.

The pivot 5*b* is rigidly coupled to the second surface 17*b,* advantageously by means of a mechanical connection, for example by means of a screw designated by the reference numeral 20*b;* the pivot 5*b* conveniently protrudes outward through an appropriately provided slot 21*b* which is formed in the side panel 4*b* and is advantageously arranged in a horizontal position, thus acting as a guide for the sliding of the pivot 5*b*.

The height of the slot 21*b* is advantageously smaller than the diameter of the pivot 5*b,* so as to prevent movements thereof along its axis.

The third surface 18*b,* which is arranged horizontally and is connected, in a downward region, to said first and second surfaces, is adapted to rest against an upper fourth surface which is optionally constituted by the upper edge 22*b* of the side panel 4*b*.

Figure 13:
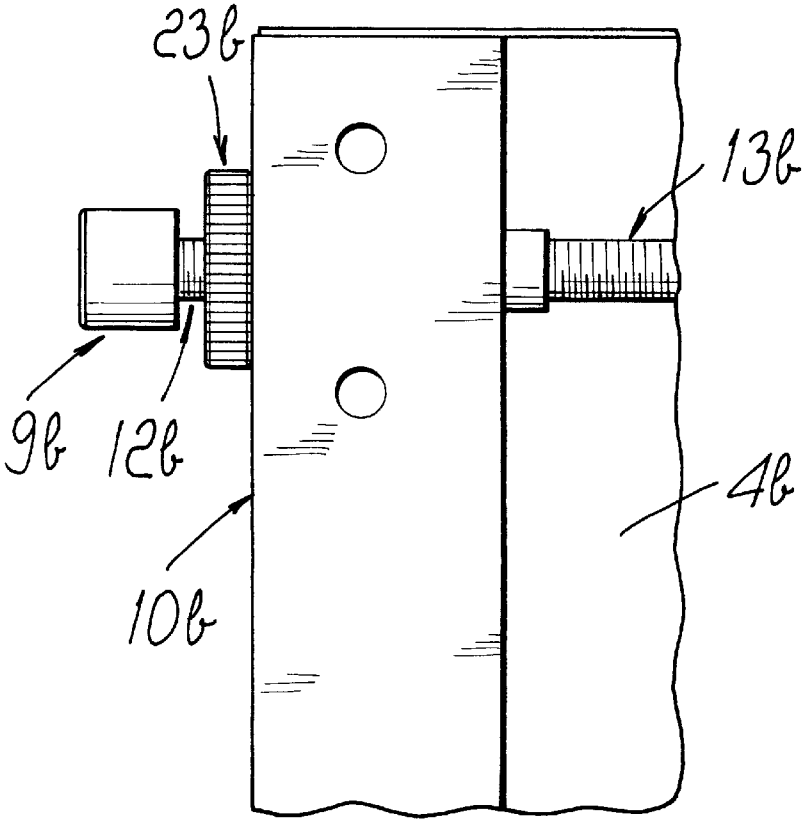
FIGS. 12 and 13 are side views of a detail of the invention, illustrating a knurled ring for locking the knob in the released and locked positions, respectively.
Figure 12:
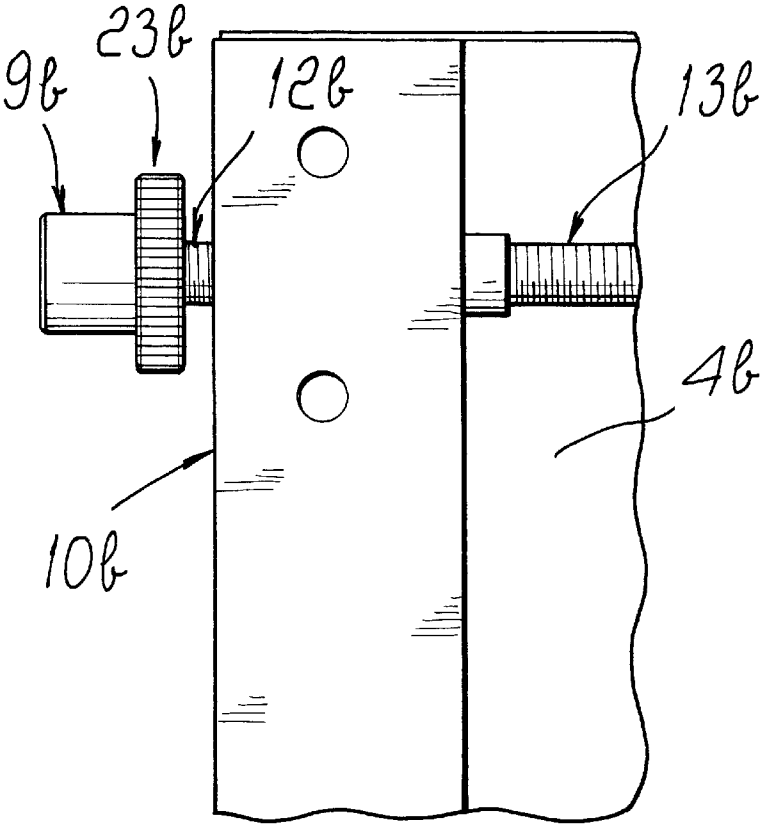

FIGS. 12 and 13 illustrate the optional presence of means for selectively locking the position of the knob 9*b* which are advantageously constituted by a knurled ring 23*b* which is screwed onto the first end 12*b* of the threaded bar 13*b,* in an intermediate position between the knob 9*b* and the front surface 10*b*.

Figure 16:
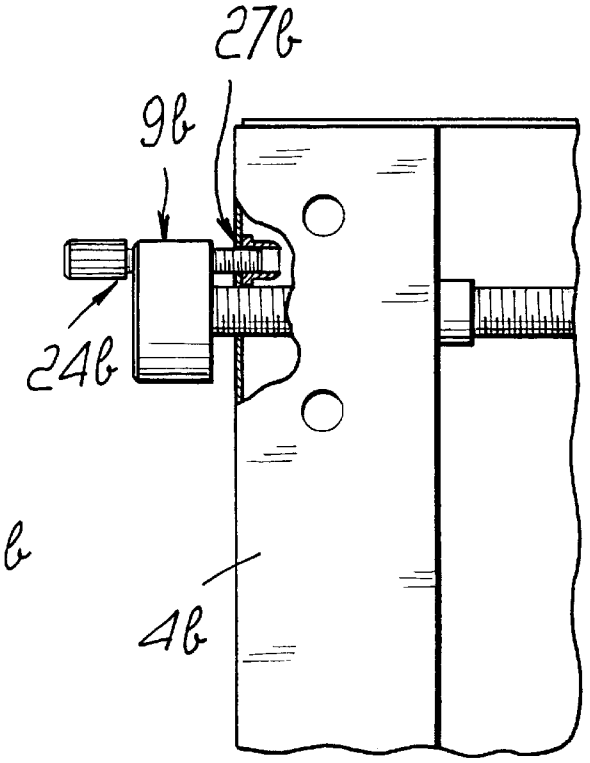
FIG. 16 is a sectional side view of the eccentric pivot for locking the knob, arranged in the locking position.
Figure 15:
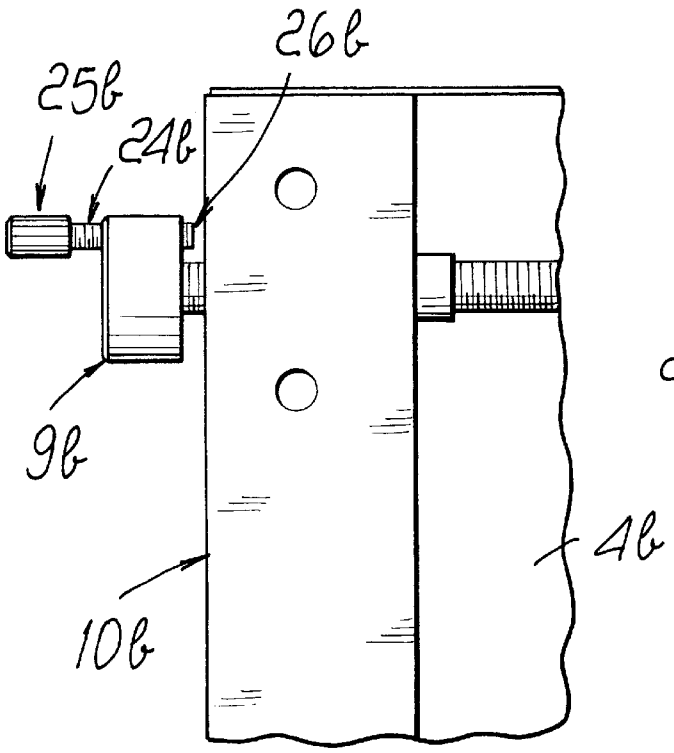
FIGS. 14 and 15 are respectively a front view and a side view of a detail of the invention which illustrates an eccentric pivot for locking the knob, arranged in the released position.
Figure 14:
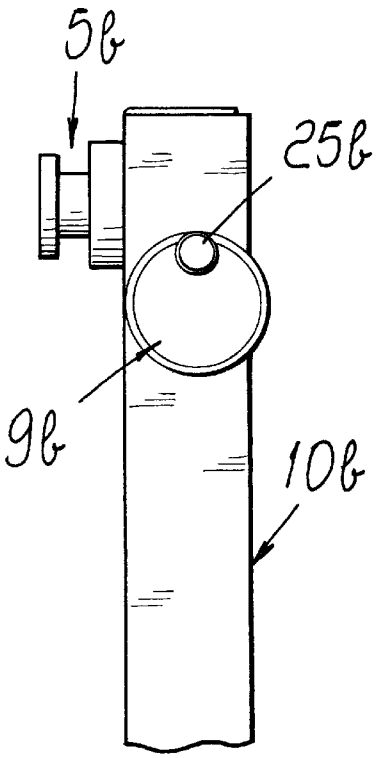

FIGS. 14, 15 and 16 illustrate a second type of means for selectively locking the knob 9*b* which are constituted by an eccentric pivot, designated by the reference numeral 24*b,* which can move axially and has a head 25*b* and a stem 26*b*.

The eccentric pivot 24*b* is adapted to temporarily engage, at the stem 26*b,* a suitable complementarily shaped seat 27*b* which is formed at the front surface 10*b*.

The position-varying means can optionally consist, as an alternative to the knobs, of at least one electric motor whose motor shaft is advantageously but not exclusively coaxial to the respective threaded bar, which is connected thereto by way of first transmission means, for example mechanical gears, which are adapted to transmit the rotary motion.

The at least one electric motor, which can be advantageously operated by the user, can in turn be associable, by way of second transmission means, for example transmission belts and mechanical gears, with the threaded bar arranged at the opposite side panel, so as to actuate the simultaneous movement of both of said threaded bars.

Operation is therefore as follows. With reference to FIG. 1, the user can, depending on whether the door of the oven 2 is opened or on the particular arrangement of items on the set of burners 3, simultaneously turn the two knobs 9*b* clockwise or counterclockwise, so as to be able to reduce or eliminate the inclination assumed by the cooker unit 1.

By turning the optionally provided knurled rings until they rest against the respective front surfaces, it is possible to lock the knobs 9*b,* so as to avoid accidental rotations thereof due for example to unintended contacts.

The rotation thus imparted to the two threaded bars 13*b* associated with the knobs 9*b* in fact causes the translatory motion of the respective brackets and of the pivots rigidly coupled thereto in the intended direction, thus returning the center of gravity of the cooker unit 1 to the vicinity of the vertical plane that passes between the two pivots 5*a* and 5*b*.

As an alternative to this locking method, it is possible to provide an eccentric pivot, arranged on the knob 9*b,* which by sliding axially can lock in an appropriately provided seat formed in the respective lateral surface.

The head of the eccentric element, which is optionally knurled in order to facilitate its grip, can also facilitate the rotation of the knob 9*b* if it is a crank.

It has thus been observed that the invention has achieved the intended aim and objects, a device having been provided which allows to use, in a watercraft, a surface or an electric appliance which remains level even when the weights placed on it vary.

The materials employed, as well as the dimensions that constitute the individual components of the invention, may of course be more pertinent according to specific requirements.

The disclosures in San Marino Patent Application No. SMA199900005 from which this application claims priority are incorporated herein by reference.

What is claimed is:

1. An electric appliance comprising:

a top surface;

two vertical side panels, each side panel being provided with:

a longitudinal slot placed proximate to the upper side of said side panel, a pivot for pivoting to a fixed support of the side panel, said pivot protruding laterally and being slidingly located in the longitudinal slot;

adjusting means which can be activated by the user for varying the position of the pivots in the longitudinal slots, to compensate for the inclination assumed by the electric appliance wherein said adjusting means comprise a pair of mechanisms, each arranged proximate to a respective upper side of said side panels, wherein said mechanisms are adapted to vary the position of said pivots with respect to said fixed support, which is constituted by two fixed vertical elements, wherein said mechanisms comprise a pair of knobs which rotatably protrude from respective front surfaces of said side panels at a pair of first holes and wherein a first end of a threaded bar is rigidly coupled to each one of said knobs at an axis that is directed toward the inside of said side panel.

2. The electric appliance according to claim 1, wherein said threaded bar is arranged at right angles to said front surface and is screwed at a second end to a wing of a bracket which has a box configuration.

3. The electric appliance according to claim 2, wherein said bracket, has a first flat surface, a second flat surface, and a third flat surface which have a rectangular plan shape and are conveniently arranged at right angles to each other.

4. The electric appliance according to claim 3, wherein said first surface, constituted by said wing, is arranged at right angles to said threaded bar and has a second hole which is shaped complementarily to said threaded bar for rotary connection thereto.

5. The electric appliance according to claim 4, wherein said second surface is arranged parallel to said side panel.

6. The electric appliance according to claim 5, wherein said pivot is rigidly coupled to said second surface, by way of mechanical connection means, said pivot protruding outward through said longitudinal seat formed in said side panel.

7. The electric appliance according to claim 6, wherein said third surface, arranged horizontally and connected in a downward region to said first and second surfaces, is suitable for resting against an upper fourth surface which is constituted by an upper edge of said side panel.

8. The electric appliance according to claim 6, wherein said slot has a height which is smaller than a diameter of said pivot, so as to prevent movements thereof along an axis thereof.

9. The electric appliance according to claim 1, wherein said adjusting means also comprise at least one electric motor which can be operated by the user, a shaft of said motor being associated, optionally by means of gears, with one or both of said threaded bars.

10. The electric appliance according to claim 1, further comprising means for selectively locking a position of said knob, said means being constituted by a knurled ring which is screwed onto said first end of said threaded bar, in an intermediate position between said knob and said front surface.

11. The electric appliance according to claim 1, further comprising means for selectively locking the knob, constituted by an eccentric pivot which can move axially and is adapted to temporarily engage a suitable complementarily shaped seat formed at said front surface.

12. The electric appliance according to claim 11 wherein said electric appliance is a set of burners of a gas cooker for watercraft.

* * * * *